US006485586B1

(12) United States Patent
Gill et al.

(10) Patent No.: US 6,485,586 B1
(45) Date of Patent: Nov. 26, 2002

(54) LOWER BURNING RATE, REDUCED HAZARD, HIGH TEMPERATURE INCENDIARY

(75) Inventors: Robert C. Gill, White Plains, MD (US); Carl Gotzmer, Accokeek, MD (US); Pamela Carpenter, Indian Head, MD (US); Eric Schlegel, Indian Head, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 165 days.

(21) Appl. No.: 09/697,252

(22) Filed: Oct. 27, 2000

(51) Int. Cl.[7] ..... C06B 45/10

(52) U.S. Cl. ..... 149/18; 149/19.3; 149/22; 149/108.2

(58) Field of Search ..... 149/19.3, 18, 19.91, 149/22, 108.2

(56) References Cited

U.S. PATENT DOCUMENTS

| | | | | | |
|---|---|---|---|---|---|
| 2,995,431 | A | | 8/1961 | Bice | 52/5 |
| 3,638,573 | A | * | 2/1972 | Campbell | 102/364 |
| 3,986,909 | A | | 10/1976 | Macri | 149/19.9 |
| 3,998,676 | A | | 12/1976 | Plauson et al. | 149/7 |
| 4,131,498 | A | * | 12/1978 | Lucy | 149/19.3 |
| 4,331,080 | A | | 5/1982 | West et al. | 102/301 |
| 4,376,083 | A | | 3/1983 | Ulsteen | 264/3 D |
| 4,402,705 | A | * | 9/1983 | Daume et al. | 149/108.2 |
| 4,428,786 | A | | 1/1984 | Arni | 149/21 |
| 4,432,818 | A | * | 2/1984 | Givens | 149/108.2 |
| 4,470,855 | A | | 9/1984 | Bampfield | 149/2 |
| 4,482,405 | A | | 11/1984 | Wright | 149/19.3 |
| H169 | H | * | 12/1986 | Mackenzie et al. | 149/19.3 |
| 4,840,687 | A | | 6/1989 | Forsberg et al. | 149/2 |
| 4,944,815 | A | | 7/1990 | Consaga | 149/19.1 |
| 4,978,400 | A | | 12/1990 | Juneau, Jr. et al. | 149/21 |
| 5,187,320 | A | | 2/1993 | Yunan | 102/275.8 |
| 5,468,313 | A | | 11/1995 | Wallace, II et al. | 149/53 |
| 5,529,649 | A | | 6/1996 | Lund et al. | 149/19.3 |
| 6,298,784 | B1 | * | 10/2001 | Knowlton et al. | 102/205 |
| 6,354,222 | B1 | * | 3/2002 | Becker et al. | 102/367 |
| 6,402,864 | B1 | * | 6/2002 | Gill et al. | 149/108.2 |
| 6,409,854 | B1 | * | 6/2002 | Gill et al. | 149/108.2 |

* cited by examiner

*Primary Examiner*—Edward A. Miller
(74) *Attorney, Agent, or Firm*—Mark Homer

(57) ABSTRACT

A low burning rate, high temperature incendiary composition having a reactive material of titanium, a second reactive material of boron, an oxidizer of polytetrafluoroethylene in an amount of from about 20 weight percent or greater of the composition and a binder of paraffin wax in an amount of from about 5 weight percent to about 20 weight percent. The composition is safe to handle, ignites readily, burns at a low and controlled rate and produces a very high flame temperature.

10 Claims, No Drawings

LOWER BURNING RATE, REDUCED HAZARD, HIGH TEMPERATURE INCENDIARY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to incendiary compositions. More particularly, the incendiary composition of the present invention contains a paraffin wax as a binder to improve ESD sensitivity of titanium/boron/polytetrafluoroethylene compositions. Most particularly, the paraffin wax is present in amounts of from about 5% to about 20%.

2. Brief Description of the Related Art

Reducing the electrostatic discharge sensitivity (ESD) for dry metals is particularly important in the manufacture of incendiary devices. Highly reactive metals provide an excellent source for high burn temperatures, however, the more reactive the metal powders are, the more ESD sensitive they become. ESD sensitive metal powders are likely to ignite during handling or mixing, increasing hazards to personnel and manufacturing equipment.

Combinations of titanium and boron potentially possess extremely high ESD sensitivity, with ignition of approximately 0.0084 joules possible. Other types of metallic mixtures that are less ESD sensitive, such as iron oxide and aluminum, i.e., Thermite, burn too quickly and with relatively low flame temperatures. Some combinations of magnesium, teflon and Viton A, i.e., MTV, high a high flame temperature, but they don't have the slow burning rate.

In view of the foregoing, there is a need for improved incendiary compositions having a reduced burning rate, low ESD sensitivity and high flame temperature. The present invention addresses this need.

SUMMARY OF THE INVENTION

The present invention includes a high temperature incendiary composition comprising a reactive material of titanium, a second reactive material of boron, an oxidizer of polytetrafluoroethylene in an amount of from about 20 weight percent or greater of the composition and a binder of paraffin wax in an amount of from about 5 weight percent to about 20 weight percent, wherein the ratio of titanium to boron ranges from about 81/19 to about 69/31.

Additionally, the present invention includes a high flame temperature product from the process comprising the steps of providing a composition of titanium, boron, polytetrafluoroethylene in an amount of from about 20 weight percent or greater of the composition and paraffin wax in an amount of from about 5 weight percent to about 20 weight percent, wherein the ratio of titanium to boron ranges from about 81/19 to about 69/31 and igniting the composition.

The present invention provides an incendiary composition having a slow burn rate and high flame temperature that is safer to handle and mix because of a reduced sensitivity to ESD.

DETAILED DESCRIPTION OF THE PREFERRED EMBODIMENT

The present invention relates to incendiary compositions with improved electrostatic discharge (ESD) sensitivity. The incendiary compositions contain a paraffin wax binder to improve ESD sensitivity of titanium, boron and polytetrafluoroethylene composition mixtures. The incendiary compositions are safe to handle, ignite readily, burn at a low and controlled rate and produce a very high flame temperature.

Safe ESD for manufacture and handling of the present invention is in a range greater than 0.023 joules. The human body is capable of producing up to approximately 0.0084 joules. The high temperature incendiary composition of the present invention contains a reactive material of titanium, a second reactive material of boron, an oxidizer of polytetrafluoroethylene, which further includes a binder of paraffin wax that increases the ESD resistance for the titanium/boron/polytetrafluoroethylene combination to a value of more than 0.023 joules and a burning rate of from about 1.0 inch per minute or less.

The composition preferably comprises fine or integrated mixtures of the titanium and boron metals, rather than mere individual aggregates, granules or pellets of the separate metals. The metals are preferably pure form, containing no oxides or other chemical forms. On ignition, the titanium and boron react exothermically together to result in intermetallic compound with a heat energy release of from about 1000 calories per gram. As the purity of the two metals increase, the energy release from the exothermic reaction also increases. Impurities promote side reactions, create stoichiometric imbalances, and dissipate released energy.

Calculations show the mixture of the two reactive metals or titanium and boron forms an intermetallic compound together upon ignition. Solid titanium and boron react to form a liquid, i.e., molten, intermetallic compound, indicated by the formula:

$$Ti+2B \rightarrow TiB_2$$

Other by-products occur, most significantly with the reaction of boron with polytetrafluoroethylene, and the reaction of the paraffin wax with titanium.

The titanium preferably comprises a particle size of from about 44 microns to about 150 microns, with ESD sensitivity increasing to unsafe levels below from about 44 microns and burn rates increasing beyond a slow burn rate above a particle size of from about 150 microns. Particle sizes from about 200 microns provide a burning rate of approximately 4.7 inches per minute or 321 grams per minute. Appropriate particle sizes for the titanium within the particle size range of from about 44 microns to about 150 microns may be used as determined by those skilled in the art for a given purpose in light of the disclosure herein. Boron particles may include any acceptable size, such as from about 0.5 microns to about 1 micron in size, as determined by one of ordinary skill in the art. The chemicals are commercially available in finely divided powders. Titanium powder metal is available from Atlantic Equipment Engineers of Bergenfield, N.J. under the catalog number TI-109 having a purity of approximately 99.7%. Boron is available from Callery Chemical Company of Pittsburgh, Pa. under the tradename SB 95 having from about 95% to about 97% boron and from about 5% to about 3% magnesium oxide (MgO) or SB 90 having from about 90% to about 92% boron and from about 10% to about 8% magnesium oxide (MgO), with both products having an amorphous state with an average particle size of approximately 0.6 microns.

The weight ratio amount of titanium to boron needed for a high flame temperatures ranges from about 81/19 to about 69/31. Preferably within this range, the titanium and boron are present in the composition in substantially stoichiometric proportions for forming the intemetallic compound. As the ratio of titanium to boron decreases, the combination metal becomes increasingly more difficult to ignite, with the proper ratio of titanium to boron for a given incendiary composition determinable by those skilled in the art in light of the disclosure herein.

The incendiary composition includes an oxidizer of polytetrafluoroethylene, also known as Teflon®, in an amount of from about 20 weight percent or greater of the composition. Preferred amounts of polytetrafluoroethylene range from about 20 weight percent to about 30 weight percent, with more preferred amounts of polytetrafluoroethylene ranging from about 20 weight percent to about 25 weight percent. The particles of the polytetrafluoroethylene may be any suitable size, such as from about 20 microns to about 450 micron, with little affect on the burning rate or slag percentage. For example, a polytetrafluoroethylene particle size between 20 microns and 450 microns in a given composition may vary in burning rates between from about 163 grams per minute to about 161 grams per minute with a slag percentage varying between from about 36% to about 40%. As the amount of polytetrafluoroethylene increases, the reaction energy of the titanium/boron ignition decreases, with the proper amount of polytetrafluoroethylene for a given incendiary composition determinable by those skilled in the art in light of the disclosure herein. Polytetrafluoroethylene is available from E. I. duPont de Nemours & Company of Wilmington, Del. under the tradename—Teflon® 7C.

The paraffin wax binder is included within the incendiary composition in an amount of from about 5 weight percent to about 20 weight percent. Preferred amounts of paraffin wax range from about 5 weight percent to about 15 weight percent, with more preferred amounts of paraffin wax ranging from about 5 weight percent to about 10 weight percent. Paraffin wax has a melting point of from about 73° C. to about 80° C., permitting ease of handling. Other waxes of similar characteristics, preferably with at least as high melting point, such as from about 80° C. or greater, i.e., 83° C., may be used in place of the paraffin wax binder. This permits storage and handling in areas with limited or uncontrolled environments, i.e., storage compartments on ships. As the amount of paraffin wax increases, the flame temperature and burning rate decrease, with the proper amount of paraffin wax for a given incendiary composition determinable by those skilled in the art in light of the disclosure herein. Paraffin wax is available from Aldrich Chemical Company, Inc. of Milwaukee, Wis. under catalog #411671, high temperature paraffin wax with a melting range of from about 73° C. to about 80° C.

The incendiary composition may be manufactured in a safe manner by decreasing the electrostatic discharge hazard during handling and mixing. The preferred method for preparing the composition of the present invention includes adding the non-binder components, i.e., titanium, boron, an polytetrafluoroethylene, into a bowl before mixing. After the component powders are added, the electrostatic field (E-field) is measured. A commercially available electrostatic fieldmeter is used and measurement is determined according to the manufacturer's directions. E-field measurements of 3 kilovolts per inch or less permit the method to proceed, with the addition of the paraffin wax. Prior to adding the paraffin wax, the paraffin wax is pre-softened with toluene, or other suitable solvent such as benzene, chloroform, warm alcohol and other like solvents, with the proper selection of solvent determinable by one skilled in the art. Once the paraffin wax has been added, the components are mixed for a total of approximately two and one-half hours. Every halfhour, during the first two hours, the mixing is stopped and the blades and sides of the bowl are scrapped with a conductive spatula. During the last half-hour, the temperature of the mixture is increased from about 90° F. to about 140° F. by circulating hot water through the mixing bowl, and a stream of air and/or a vacuum is used to remove the solvent.

A high flame temperature product results with the ignition of the incendiary composition of the 81/19 to 69/31 ratio of titanium and boron, 20 weight percent or more polytetrafluoroethylene and 5 weight percent to 20 weight percent paraffin wax. Temperatures of the incendiary composition igniting may range from about 3500° F. or higher, with temperatures from about 4000° F. to about 5000° F. possible, such as approximately 4500° F. As the incendiary composition comprises lesser amounts of paraffin wax, such as 5 weight percent to 10 weight percent, the flame temperature increases. As the incendiary composition comprises less polytetrafluoroethylene, such as from 20 weight percent to 30 weight percent, the reaction energy increases.

EXAMPLE 1

Titanium in an amount of 1215 grams was placed in a one-gallon size vertical mixer. Boron in an amount of 285 grams was added to the mixer, as well as polytetrafluoroethylene in an amount of 400 grams. The E-field was measured at less than 3 kilovolts per inch. Paraffin wax in an amount of 100 gram was combined with approximately 50 milliliters (43 g) of toluene, and the paraffin wax/toluene combination was added to the mixer. After the paraffin wax was added, the components were mixed for a total of approximately two hours. Every halfhour, during the first one and one-halfhours, the mixture was stopped and the blades and sides of the bowl were scrapped with a conductive spatula. During the last half-hour, the temperature of the mixture was increased from about 90° F. to about 140° F. and a vacuum of 20 mm of Hg was placed over the mixed components for approximately one-half hour to remove the toluene.

The 2000 grams of incendiary composition had a Ti/B ratio of 81/19. The burn rate was measured at 1.0 inches per minute or 78 grams per minute (burned in a two inch diameter "FORBON" tube) and the slag left from the burn measured at 46%, and the ESD was measured at 0.095 joules.

EXAMPLE 2

Titanium in an amount of 1033.40 grams was placed in a one-gallon size vertical mixer. Boron in an amount of 466.60 grams was added to the mixer, as well as polytetrafluoroethylene in an amount of 400.00 grams. The E-field was measured at less than 3 kilovolts per inch. Paraffin wax in an amount of 100.00 gram was mixed with approximately 50 milliliters (43 g) of toluene, and the paraffin wax/toluene combination was added to the vertical mixer. After the paraffin wax was added, the components were mixed for a total of approximately two hours. Every half hour, during the one and one-half hours, the mixture was stopped and the blades and sides of the bowl were scrapped with a conductive spatula. During the last half-hour, the temperature of the mixture was increased from about 90° F. to about 140° F. and a vacuum of 20 mm of Hg was placed over the mixed components for approximately one-half hour to remove the toluene.

The 2000 grams of incendiary composition had a Ti/B ratio of 68.9/31.1. The burn rate was measured at 1.0 inches per minute or 71 grams per minute (sample was burned in a two diameter tube of "FORBON"), and the slag measured at 27%.

EXAMPLE 3

Titanium in an amount of 1125 grams was placed in a one-gallon size vertical mixer. Boron in an amount of 375 grams was added to the mixer, as well as polytetrafluoroethylene in an amount of 400 grams. The E-field was measured at less than 3 kilovolts per inch. Paraffin wax in an amount of 100 gram was mixed with approximately 50 milliliters (43 g) of toluene, and the paraffin wax/toluene combination was added to the vertical mixer. After the paraffin wax was added, the components were mixed for a total of approximately two hours. Every half hour, during the first one and one-half hours, the mixture is stopped and the blades and sides of the bowl were scrapped with a conductive spatula. During the last half-hour, the temperature of the mixture is increased from about 90° F. to about 140° F. and a vacuum of 20 mm of Hg was placed over the mixed components for approximately one-half hour to remove the toluene.

The 2000 grams of incendiary composition had a Ti/B ratio of 75/25. The burn rate was measured at 0.9 inches per minute or 74 grams per minute (burned in a two diameter "FORBON" tube), and the slag measured at 41%.

EXAMPLE 4

Titanium in an amount of 60.75 pounds was placed in a twenty-five size gallon horizontal mixer. Boron in an amount of 14.25 pounds was added to the mixer, as well as polytetrafluoroethylene in an amount of 20.00 pounds. The E-field was measured at less than 3 kilovolts per inch. Paraffin wax in an amount of 5.00 pounds was hand mixed with approximately 1.9 pounds (1 liter) of toluene, and the paraffin wax/toluene combination was added to the horizontal mixer. After the paraffin wax was added, the components were mixed for a total of approximately two hours. Every half hour, during the first one and onehalf hours, the mixture was stopped and the blades and sides of the bowl were scrapped with a conductive spatula. During the next to last half-hour, the temperature of the mixture was increased from about 90° F. to about 140° F. and a stream of air was used to assist in removing the toluene. The stream of air was continued and the drying of the 140° F. mixture completed during the last one-half hour.

The 100 pounds of incendiary composition had a Ti/B ratio of 81/19. This material was compacted in "FORBON" tubes and successfully tested.

EXAMPLE 5

Titanium in an amount of 167.06 pounds was placed in a one-hundred gallon size horizontal mixer. Boron in an amount of 39.19 pounds was added to the mixer, as well as polytetrafluoroethylene in an amount of 55.00 pounds. The E-field was measured at less than 3 kilovolts per inch. Paraffin wax in an amount of 13.75 pounds was hand mixed with approximately 6.5 pounds (3.4 liters) of toluene, and the paraffin wax/toluene combination was added to the horizontal mixer. After the paraffin wax was added, the components were mixed for a total of approximately two and one-half hours. Every half hour, during the first two hours, the mixture was stopped and the blades and sides of the bowl were scrapped with a conductive spatula. During the last half-hour, the temperature of the mixture was increased from about 90° F. to about 140° F. and a stream of air directed on the mixture to remove the toluene.

The 275 pounds of incendiary composition had a Ti/B ratio of 81/19.

Comparative Example 1

Titanium in an amount of 48.60 pounds was placed in a twenty-five size gallon horizontal mixer in which a temperature of 140° F. was maintained. Boron in an amount of 11.40 pounds was added to the mixer, as well as polytetrafluoroethylene in an amount of 16.00 pounds. The E-field was measured at less than 3 kilovolts per inch. CTBN binder ingredients in an amount of 4.00 pounds were added to the mixer. After the CTBN was added, the components were mixed for a total of approximately two hours. Every half hour, during the first one and one-half hours, the mix was stopped and the blades and sides of the bowl were scrapped with a conductive spatula.

The 80 lbs of incendiary composition had a Ti/B ratio of 81/19. The burn rate was measured at 1.7 inches per minute or 163 grams per minute (burned in a two inch diameter "FORBON" tube), slag was measured at 36%, and the ESD was measured at 0.095 joules. These measurements showed the CTBN binder composition had a significantly higher burn rate of 1.7 inches per minute.

Comparative Example 2

Titanium in an amount of 1033.40 grams was placed in a one-gallon size vertical mixer. Boron in an amount of 466.60 grams was added to the vertical mixer, as well as polytetrafluoroethylene in an amount of 400.00 grams. The E-field was measured at less than 3 kilovolts per inch. Polyethylene in an amount of 100.00 grams was mixed with approximately 100 milliliters (87 g) of toluene, and the polyethylene/toluene combination was added to the vertical mixer. After the polyethylene was added, the components were mixed for a total of approximately two hours. Every half hour, during the first two and one-half hours, the mixture was stopped and the blades and sides of the bowl were scrapped with a conductive spatula. During the last half-hour, the temperature of the mixture was increased from about 90° F. to about 140° F. A vacuum of 20 mm of Hg was placed over the mixed components for approximately one-half hour to aid in removal of the toluene.

The 2000 grams of incendiary composition had a Ti/B ratio of 69/31. The burn rate was measured at 1.8 inches per minute or 140 grams per minute (burned in a two inch "FORBON" tube), slag was measured at 51%, and the ESD was measured at 0.037 joules. These measurements showed the polyethylene composition burns at a significantly higher burning rate of 1.8 inches per minute.

Comparative Example 3

Titanium in an amount of 1215.00 grams was placed in a one-gallon vertical size mixer. Boron in an amount of 285.00 grams was added to the vertical mixer, as well as polytetrafluoroethylene in an amount of 400.00 grams. The E-field was measured at less than 3 kilovolts per inch. Chlorinated polyethylene in an amount of 100.00 grams was mixed with approximately 100 milliliters (87 g) of toluene, and the chlorinated polyethylene/toluene combination was added to the vertical mixer. After the chlorinated polyethylene was added, the components were mixed for a total of approximately two hours. Every half hour, during the first one and one-half hours, the mixture was stopped and the blades and sides of the bowl were scrapped with a conductive spatula. During the next to last half-hour, the temperature of the mixture was increased from about 90° F. to about 140° F. A vacuum of 20 mm of Hg was placed over the mixed components for the last one-half hour to aid in removal of the toluene.

The 2000 grams of incendiary composition had a Ti/B ratio of 81/19. The burn rate was measured at 1.6 inches per minute or 135 grams per minute (burned in two inch diameter "FORBON" tube), slag was measured at 48%, and the ESD was measured at 0.023 joules. These measurements showed the chlorinated polyethylene binder composition burns at a significantly high burning rate of 1.6 inches per minute.

Comparative Example 4

Titanium in an amount of 1215.00 grams was placed in a one-gallon size vertical mixer. Boron in an amount of 285.00 grams was added to the vertical mixer, as well as polytetrafluoroethylene in an amount of 400.00 grams. The E-field was measured at less than 3 kilovolts per inch. Cellulose acetate (CA) in an amount of 80.00 grams and lecithin in an amount of 20.00 grams was mixed with approximately 100 milliliters (87 g) of acetone, and the cellulose acetate/acetone combination was added to the vertical mixer. After the cellulose acetate was added, the components were mixed for a total of approximately two hours. Every half hour, during the first one and one-half hours, the mixture was stopped and the blades and sides of the bowl were scrapped with a conductive spatula. During the last half-hour, the temperature of the mixture was increased from about 90° F. to about 140° F. A vacuum of 30 mm of Hg was placed over the mixed components to aid in removal of the acetone.

The 2000 grams of incendiary composition had a Ti/B ratio of 81/19. The burn rate was measured at 9.7 inches per minute or 792 grams per minute (burned in a two inch diameter "FORBON" tube), slag was measured at 19%, and the ESD was measured at 0.165 joules. The burning rate for the CA binder composition was much higher at 9.7 inches per minute.

The foregoing summary, description, and examples of the invention are not intended to be limiting, but are only exemplary of the inventive features which are defined in the claims.

What is claimed is:

1. A low burning rate, high temperature incendiary composition comprising:

a reactive material of titanium;

a second reactive material of boron;

an oxidizer of polytetrafluoroethylene in an amount of from about 20 weight percent or greater of the composition; and, a paraffin wax binder in an amount of from about 5 weight percent to about 20 weight percent;

wherein the ratio of titanium to boron ranges from about 81/19 to about 69/31 and the composition comprises a burning rate from about 1.0 inch per minute or less.

2. The incendiary composition of claim 1, wherein the amount of wax binder ranges from about 5 weight percent to about 15 weight percent.

3. The incendiary composition of claim 2, wherein the amount of wax binder ranges from about 5 weight percent to about 10 weight percent.

4. The incendiary composition of claim 1, wherein the amount of polytetrafluoroethylene ranges from about 20 weight percent to about 30 weight percent.

5. The incendiary composition of claim 4, wherein the amount of polytetrafluoroethylene ranges from about 20 weight percent to about 25 weight percent.

6. The incendiary composition of claim 1, wherein the amount of titanium ranges from about 34 weight percent to about 61 weight percent.

7. The incendiary composition of claim 6, wherein the amount of titanium ranges from about 48 weight percent to about 61 weight percent.

8. The incendiary composition of claim 1, wherein the amount of boron ranges from about 9 weight percent to about 24 weight percent.

9. The incendiary composition of claim 8, wherein the amount of boron ranges from about 13 weight percent to about 24 weight percent.

10. The incendiary composition of claim 1, wherein the titanium comprises approximately 60.75 weight percent, the boron comprises approximately 14.25 weight percent, the polytetrafluoroethylene comprises approximately 20.00 weight percent, and wax binder comprises paraffin wax in an amount of approximately 5.00 weight percent.

* * * * *